United States Patent [19]

Mayenschein

[11] 4,280,211

[45] Jul. 21, 1981

[54] CLOCK APPARATUS

[76] Inventor: Harley Mayenschein, P.O. Box 117, Sextonville, Wis. 53584

[21] Appl. No.: 42,566

[22] Filed: May 25, 1979

[51] Int. Cl.[3] ..... G04B 19/00; G04C 21/00; G04B 25/00; G04C 17/00

[52] U.S. Cl. ..... 368/76; 368/223

[58] Field of Search ..... 58/1 R, 45, 46, 2, 3, 58/4 B, 144, 129, 125 R; 368/76, 223

[56] References Cited

U.S. PATENT DOCUMENTS

| | | | |
|---|---|---|---|
| 1,503,570 | 8/1924 | Weihenmeyer | 58/1 R |
| 2,729,020 | 1/1956 | Frampton | 46/43 |
| 3,522,701 | 8/1970 | Perry | 58/130 |
| 4,024,701 | 5/1977 | Corson | 58/144 |
| 4,077,198 | 3/1978 | Mayenschein | 58/1 R |

*Primary Examiner*—J. V. Truhe
*Assistant Examiner*—John B. Conklin
*Attorney, Agent, or Firm*—Michael, Best & Friedrich

[57] ABSTRACT

A novel clock apparatus is provided which visually indicates attained time of day by the continuously changing placement order of accumulated spheroids as viewed at rest through framed outlined alignment within window-like apertures, respectively, the apertures being provided in association with time related indicia and defined in an outer wall of a selected housing enclosure. A spheroid is added to the window display for each minute of elapsed time through the provision of time referenced loading means. The housing enclosure is to be any of a variety of intriguing shapes and designs, with selected time-related groups of the apertures being either wholly horizontally aligned or selected groups of horizontally aligned apertures being vertically stacked with respect to each other. A preferred housing comprises a train-like assembly of coupled railway cars.

25 Claims, 17 Drawing Figures

FIG. 3
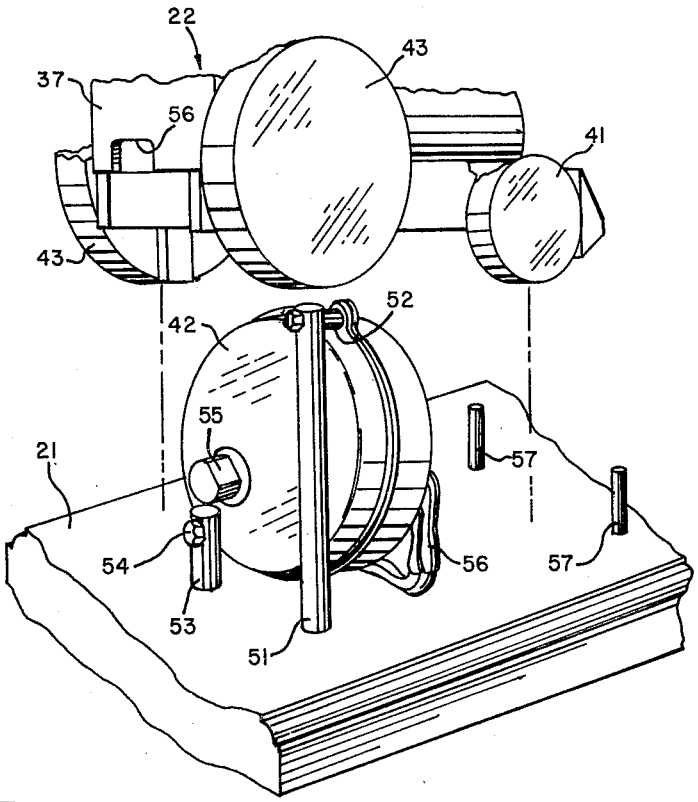
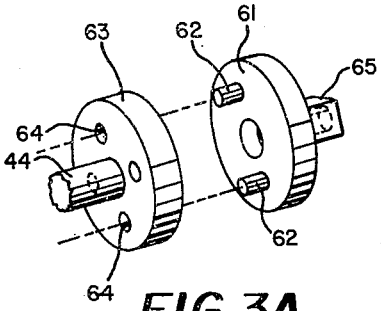
FIG. 3A
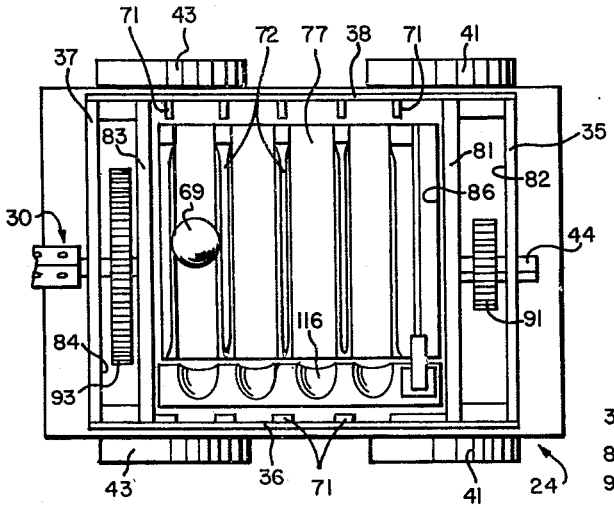
FIG. 5
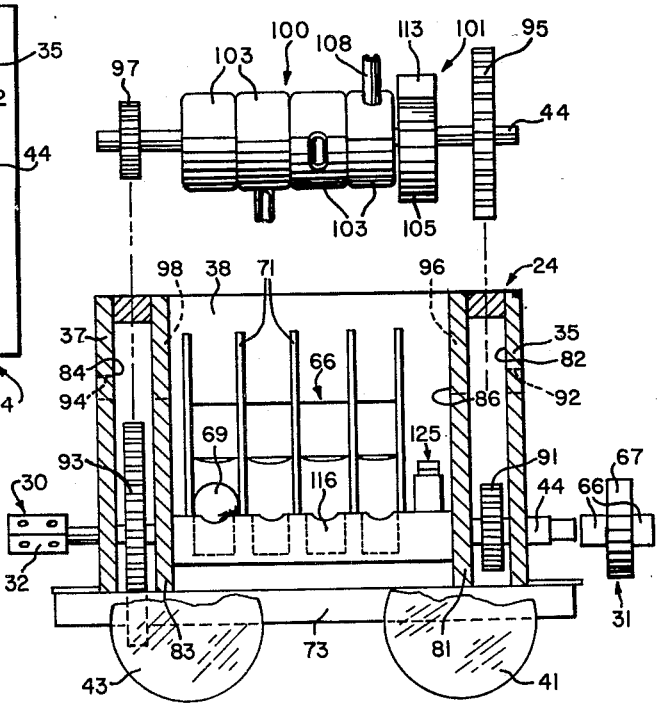
FIG. 4

CLOCK APPARATUS

BACKGROUND OF THE INVENTION

This invention relates to a novel clock apparatus, and more particularly, to an improved handless clock device providing continuous visual display of time of day indications from the positioning and re-positioning of ever-changing numbers of ball-like spheres displayed at rest upon pivotable holder members and viewed in frame through aligned timeindicating apertures in the clock housing.

The present invention is intended to provide clock means for use in indicating time of day (T.O.D.) in hours and minutes and simultaneously to delight and enrapture the observer by the viewing of time-related movements of the ball-like spheres into framed view and then out of framed view with respect to the time-indicating apertures in the clock housing. The ball-like spheres are said to be loaded into view within the time-indicating apertures in response to the attained time of day and unloaded therefrom at predetermined intervals in order to re-arrange the appearance order of the ball-like spheres in response to continued attained time of day. The clock device comprises in one preferred embodiment a relatively continuous horizontally aligned sequence of ball-holder chutes positioning the spheres in parallel sequential alignment with a corresponding number of the time-indicating apertures in the clock housing. In another preferred embodiment, the clock device is comprised of selected groups of the horizontally aligned ball-holder chutes arranged in a predetermined vertical assembly wherein each selected group of horizontally aligned chutes again positions the spheres in parallel sequential alignment with a corresponding number of the time-indicating clock housing apertures also arranged in selected groups in vertical assembly.

The clock device includes a plurality of interiorly mounted ball-driver cams mounted to a rotatable drive shaft, which shaft is driven through being coupled to an interconnectable shaft of an electric clock motor. The driver cams are aligned to engage the ball-like spheres, respectively, an individual one of the spheres being placed in each ball-holder chute. The time-related movements of the cams drive or load the spheres, upon engagement therewith, from the chutes into full framed view within the time-indicating housing apertures. The displayed spheres then rest upon pivotable holder members sometimes hereinafter referred to as drop bars. An individual drop bar is weight biased to follow and immediately respond to the predetermined movement of a drop cam also mounted to the drive shaft, and is responsive to the time-related rotational movement of the drop cam to cyclically pivot rearwardly away from the housing apertures in order to drop or unload the displayed spheres back into their respective aligned holder chutes.

The spheres retained on display in the time-indicating housing apertures are indicative of attained time of day. As the next-attained time of day is reached in increments of one minute (60 seconds), another sphere is added to the displayed array of spheres to provide a next higher-order time of day reading. The time-controlled continuous movements of the drive cams provide mechanical means for continuously loading and positioning the next-order alignments of spheres into framed window displays. Next-higher order attained time of day readings are provided by increased predetermined numbers of displayed spheres. At preselected time intervals, the drop bars which hold the displayed spheres are responsive to the movement of the drop cam to pivot rearwardly for depositing the displayed spheres back into their associated holder chutes. The holder chutes comprise means for holding the spheres in stored position until the time-related movements of the associated drive cams again engage preselected ones of the associated spheres for being moved into visual framed display within the time-indicating housing apertures. It is the intended function of the clock device to provide the visual framed display of a single additional sphere with each one minute next attained irregardless of the concurrent and continuous intervals of redeposit of previously displayed spheres into their associated holder chutes.

Clock devices comprise very popular consumer items and conventionally employ a variety of intricate and complex mechanical linkages and moving parts. Traditionally, clock faces present so-called movement hands or arms which represent attained time of day by means of their ever-changing angular positions as viewed against a background of standard indicia of numerals. Clock devices utilize movements and sound to mark the passage of or attainment of time as well as to intrigue the viewer. Time of day references are indicated by a wide variety of symbols and/or numerals, including alphanumerical and digital numerals. Very often, clock devices become popular consumer items just as well through the aesthetic configuration and visual aspects thereof as through the functional accuracy and dependability thereof. The present invention discloses a clock device which is intended to be at once intriguing and entertaining to the viewer as well as functional and accurate to maintain time of day. The present inventor is also the inventor of another entertaining and novel clock device which uses displayed arrays of spheres to mark attained time of day, and the referenced clock device is the subject of the disclosure of U.S. Pat. No. 4,077,198, to which reference may be had by the reader for a more detailed treatment thereof.

The present invention provides means for measuring time of day through the embodiment of a novel clock apparatus which indicates time of day without the utilization of angular referenced movement hands or a lighted digital display and without an extraordinarily large number of intricate and detailed mechanical parts, but indicates time of day by means of an unusual manner of visually displaying window-framed spheres, the displayed numbers of spheres being time-referenced to count attained time of day. The preferred embodiments hereof maintain time of day with a timing accuracy to the nearest minute (60 seconds) and with a contrasting simplicity for reading time of day wherein the movements of the spheres into and from the window displays have the effect of immediately capturing the continued interest of the viewer. The present clock device provides a closed endless loop motion system wherein time of day can be continuously maintained without any scheduled resetting or re-arrangement of spheres so long as electric power is maintained to an electric clock motor providing timing source means, and without need of any re-activation of any mechanical clock movement. Calibration is a simple function accomplished by mechanically decoupling the clock drive shaft from the clock motor shaft and mechanically rotating the drive shaft until the desired time of day is displayed prior to recoupling the clock motor shaft.

In a preferred embodiment of the novel clock device, there is provided a clock apparatus employing continuous movements of spheroid means to provide attained time of day comprising in combination housing means including a plurality of time-indicating apertures defined in a selected outer wall portion thereof, a plurality of spherical units, at least a corresponding number of spherical holder chutes mounted within the housing means and normally containing the spherical units at rest therein, the number of said holder chutes generally corresponding in number to the number of time-indicating housing apertures, horizontally aligned rotatable drive shaft means supported within the housing means, means for coupling the drive shaft means to clock motor drive means, a plurality of driver cam members adjacently mountable on the shaft means and arranged in predetermined time-referenced rotational orientations with respect to each other, the cam members including protrusion members, respectively, engageable with associated contained spherical units at rest on the holder chutes, respectively, and being moved into engagement therewith in response to time-related rotational movement of the drive shaft means, selected ones of the spherical units being positioned for visual framed display within the associated time-indicating aperture of the housing means, for providing an attained time of day reading, selected other ones of the spherical units being moveable into position for visual framed display within associated ones of the time-indicating apertures for providing next-order attained time of day readings, pivotable spherical holder means positioned adjacent to the time-indicating apertures and effective to hold a preselected number of spherical units for visual framed display within the associated time-indicating apertures, the spherical holder means having moveable cam follower means responsive to the rotation of the drive shaft means to alternately provide first and second positions for the holder means, said first position being effective to display the associated spherical units within the time-indicating apertures and said second position thereof being effective to redeposit the displayed spherical units into the associated holder chutes, respectively, the spherical units at rest on the holder means comprising means for biasing the holder means to be responsive to the movements of the cam follower means for selectively biasing the holder means to pivot to the second position of the holder means whereby said displayed spherical units are unloaded into the associated holder chutes.

The preferred embodiments for the clock device described above can be readily configured to provide a continuous horizontal drive shaft, a parallel adjacent and continuous horizontal array of ball-holder chutes, and a parallel adjacent and continuous horizontal array of time-indicating apertures in the outer housing wall. Alternatively, the same preferred embodiment for the clock device can be readily configured to provide predetermined horizontal groupings of chute arrays to be vertically stacked with respect to each other and each such grouping thereof to be associated with a grouping of parallel adjacent time-indicating apertures and a parallel section of drive shaft. The housing means for the preferred embodiment can be any selected configuration or design so long as a selected outer wall thereof is provided with the desired number of time-indicating apertures, either arranged in horizontal alignment or in vertically stacked predetermined groups of horizontally aligned apertures. The design of the housing means is desired to be entertaining and interesting to the viewer; hence, a primary preferred housing means for the horizontally aligned embodiment of clock apparatus comprises a train assembly of coupled railway cars consisting of an engine car, a coal car and a linked pair of passenger cars, all coupled and mounted stationary on a base substrate member. Any number of suitable housing means can be provided to present visual arrays of time-indicating apertures preferably arranged in vertically stacked groups of horizontally aligned apertures associated with corresponding vertically stacked groups of clock apparatus. Preferably, the vertically stacked groups of apertures will provide three planar levels associated with time in hours, in five-minute increments, and in one-minute increments up to each five-minute increment. It is at once apparent to the skilled practitioner in the art field that a variety of other equally suitable housing embodiments and configurations could be utilized wherein the clock apparatus is configured in either the singular horizontal alignment or the vertically stacked predetermined groups of horizontally aligned clock structure, and the invention hereof is not to be limited solely to the disclosed preferred embodiment of housing.

The horizontally aligned embodiment of the preferred clock apparatus is comprised of separably coupled clock apparatus groupings presenting predetermined ball-display patterns relating to the display of time in hours and minutes. For example, one selected clock apparatus grouping is functional to present a ball-display pattern in one-minute increments of 1–4 minutes, another selected clock apparatus grouping is functional to present a ball-display pattern of 5–55 minutes represented in eleven 5-minute increments, and still another selected apparatus grouping presents a ball-display pattern of 1–12 hours represented in twelve 1-hour increments. The three clock apparatus groups have the capacity to present ever-changing ball-display patterns representative of or indicative of the attained time of day for twelve continuous hours, and thereafter the cycle of changeable ball-display patterns is repeated for each and every subsequently occurring twelve hour periods. The clock apparatus is not indicative of A.M. or P.M. time periods. It is convenient to locate the clock apparatus grouping having the 1–4 minute indicating ball-display pattern within the coal car of the train assembly in association with 4 time-indicating apertures in a selected side wall thereof, to locate the clock apparatus grouping having the 5–55 minute indicating ball-display pattern within the immediately rearwardly coupled passenger car of the train assembly in association with the eleven time-indicating apertures in a correspondingly selected side wall thereof, and to locate the clock apparatus grouping having the 1–12 hour indicating ball-display pattern within the next-most and final rearwardly coupled passenger car of the train assembly in association with the twelve time-indicating apertures in a correspondingly selected side wall thereof.

SUMMARY

It is therefore an object of the present invention to provide an improved and novel clock apparatus giving visual time of day indications without the use of mechanical hands or arms or without a display of lighted numerals as in so-called digital displays.

It is another object to provide another handless clock apparatus displaying ever-changing numbers of spherical units to represent attained current time of day indications.

It is still another object to provide another handless clock apparatus which provides cyclically repeating ever-changing movements of spheres being loaded or unloaded for visual reference with respect to time-indicating housing apertures.

It is yet another object to provide holder chute means for collecting the unloaded spheres and holding the same in stored position for becoming accessible to be again loaded for visual time-indicating reference.

It is still yet another object to provide said holder chute means to be fixed and stationary, and to provide adjacently positioned pivotable bar holder means which are biased by cam follower means to remain in one of two pivotable positions until the maximum number of spheres are loaded thereon, and are biased by the number of loaded spheres to move, when permitted by the cam follower means, to the other of the two pivotable positions and the unloading of the spheres onto the holder chute means.

It is a further object of the invention to provide that the time of day indicators comprise a plurality of apertures defined in the outer wall of the selected clock housing, which apertures are to be grouped to visually indicate either hours, 5-minute increments or 1–4 increments of attained time of day.

It is still a further object to provide that the time-indicating aperture groups are alternatively arranged in horizontal alignment with each other or vertical stacked alignment.

It is yet a further object to provide sphere loading means and to regulate the loading action of said sphere loading means to load spheres onto the bar holder means with time-referenced continuous motion of the sphere loading means.

It is still yet a further object of the invention to provide cam means having time-referenced angular position with respect to and being mounted on rotatable shaft means, the combination thereof comprising said sphere loading means.

It is another and further object to provide that the spherical units are ball bearing type units.

In summary, a novel clock apparatus includes housing enclosure means having an outer wall defining window-like apertures therein, time of day indicia provided in time-indicating referenced association with the apertures, a plurality of moveable spheroid units, chute assembly means supported in the housing enclosure means for holding the moveable spheroids in stored non-time indicating positions thereof, spheroid holder display means moveable between first positions thereof aligned to receive and hold moving loaded spheroids thereon in framed alignment with associated apertures, respectively, and second positions thereof aligned to depart moving unloaded spheroids therefrom for return to the chute assembly means, the moving loaded spheroids being positioned to rest on the spheroid holder display means in progressively increasing and accumulated framed alignment with next-higher order apertures and time indicia whereby the placement order of the spheroids indicate attained time of day, time-referenced loading means for loading with predetermined time referenced motion thereof the collected spheroids from the chute assembly means to be moved on to the spheroid holder display means, said time-referenced loading means to be moved in response to timing source means, means for biasing the spheroid holder display means to remain in the first position thereof in response to first predetermined movements of the loading means, and means for counter-biasing the spheroid holder display means to move to the second position thereof in response to second predetermined movements of the loading means.

Other objects and advantages of the present invention will naturally occur to those skilled in the pertinent art as the invention is described in connection with the accompanying drawing in which:

THE DRAWING

FIG. 3 is a right-sided partial perspective view of a selected portion of the train assembly showing a fractional portion of a removeable engine car housing, a section of a base member and a mounted electric clock motor;

FIG. 3A is an isolated perspective view of a coupler device used in connection with the coupled railway cars;

FIG. 4 is a partially sectioned right side view of a coal car housing showing cam means and rotatable shaft means removed therefrom, an apertured rear housing wall, gear means and pivotable bar holder means;

FIG. 5 is generally a top view of the coal car housing as shown in FIG. 4, and being unsectioned and omitting the removed cam means and rotatable shaft means;

Figure 15:
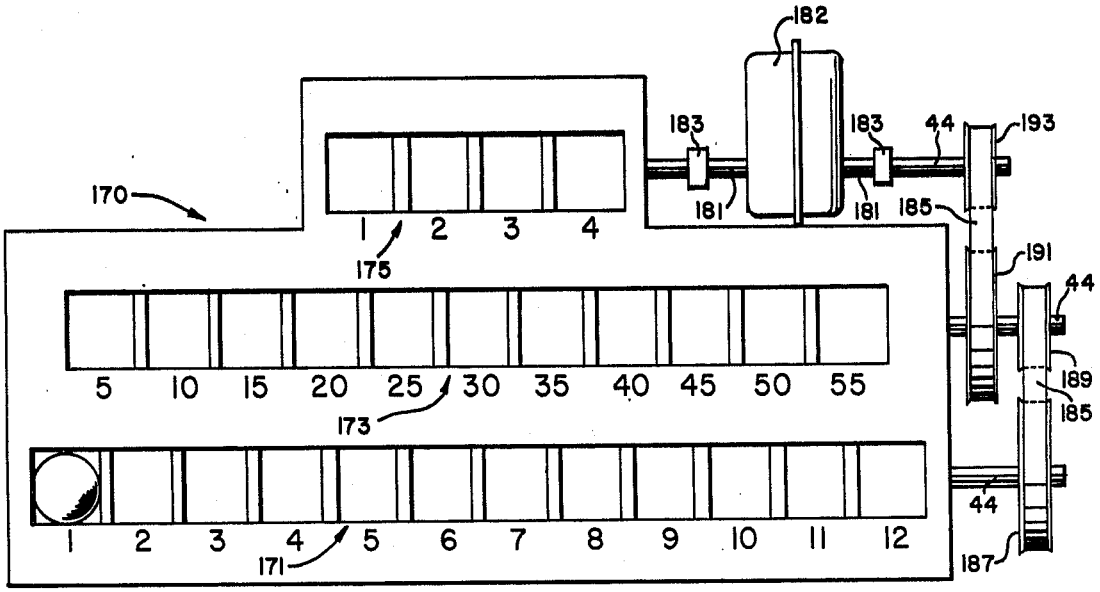
Figure 16:
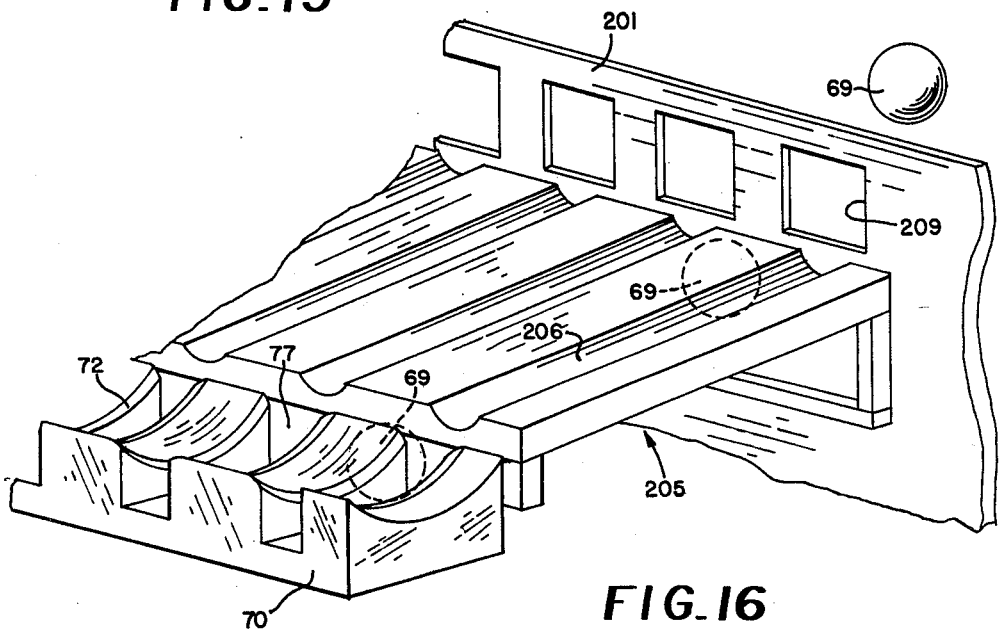

FIG. 15 is an isolated front view of an apertured section of housing wall defining alternatively arranged vertically stacked groupings of horizontally aligned apertures therein, a clock motor and vertically connected shaft and drive belt means; and FIG. 16 is a partial broken frontal perspective view of an alternative embodiment for an interconnecting ball chute assembly wherein the apertured housing wall is removed from the associated chute assembly means.

DETAILED DESCRIPTION

Figure 1:
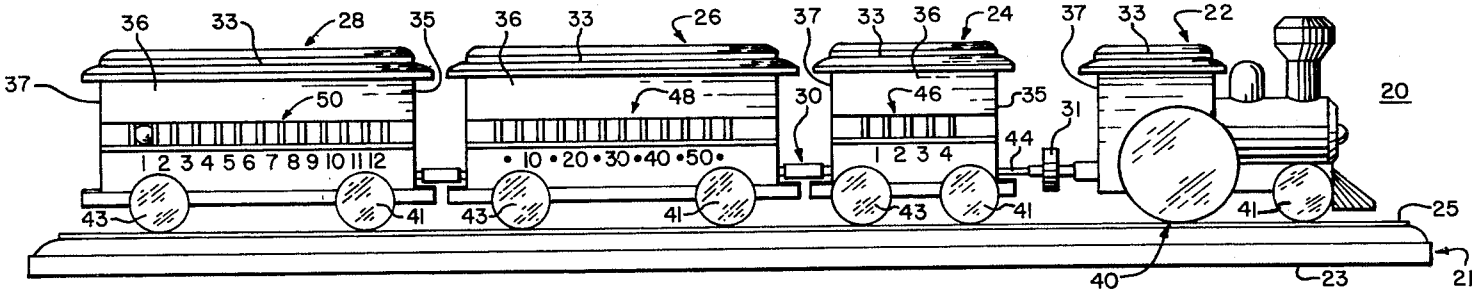
FIG. 1 is a right side elevational view of a clock apparatus embodied in the configuration of a train assembly of coupled railway cars and being constructed in accordance with the present invention.

FIG. 1 shows a novel clock timing device or apparatus constructed in accordance with the present invention and configured in the embodiment of a clock train assembly 20 presenting a clock apparatus generally of the handless variety, that is, wherein hand or arm extension members are not utilized to provide visual reference for determining indications of attained time of day. The selected housing enclosure means for the clock train assembly 20 includes in combination a base substrate member 21 of preselected length, width and thickness dimensions, a first car or engine car member 22 comprising first car or engine car housing means, a second car or coal car member 24 comprising second car or coal car housing means, a third car or passenger car member 26 comprising third car or passenger car housing means, and a fourth car or passenger car member 28 comprising fourth car or passenger car housing means, wherein the third and fourth car members 26 and 28, respectively, comprise so-called first passenger car means and second passenger car means 26 and 28, respectively. It is readily apparent with reference to FIG. 1, that the base member 21 has a bottom wall 23 upon which the train clock assembly 20 rests and a top wall 25 which acts to support the numerous component parts of the train clock assembly 20 as are hereinafter described with particular detail.

Figure 2:
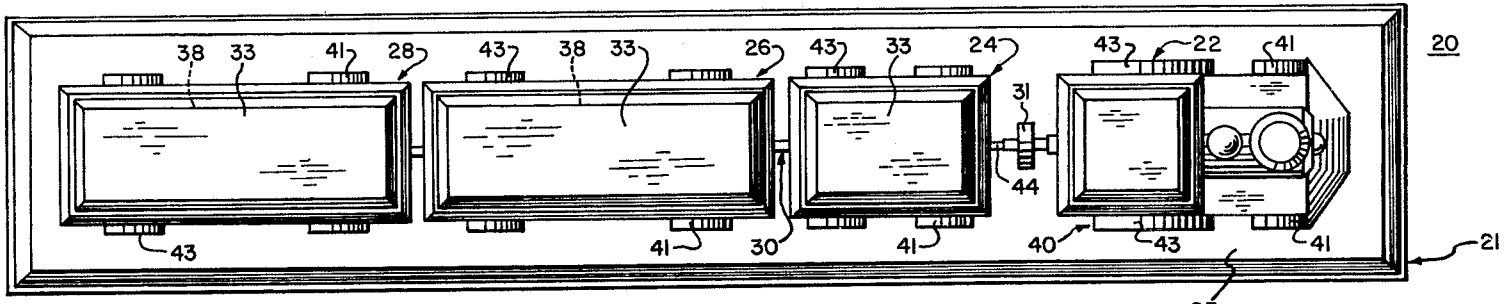
FIG. 2 is a top view of the clock apparatus of FIG. 1.

FIGS. 1 and 2 show the train clock assembly 20 to have the plurality of car members 22, 24, 26 and 28 arranged in continuous horizontal alignment and to be coupled together by intercar coupling means 30 which includes, inter alia, detachable motor coupling means 31 to be described more fully hereinafter. The car members 22, 24, 26 and 28 are generally box-shaped with each thereof having at least a top cover wall member 33, front and rear oriented end wall members 35 and 37, respectively, and right-handed and left-handed oriented side wall members 36 and 38, respectively, which are sometimes referred to as front and rear side wall members 36 and 38, respectively. Each car members is provided with wheel means 40 comprised of two axial pairs of wheel members oriented as a front axial pair of wheel members 41 and a rear axial pair of wheel members 43. The directional orientations given are to be taken with reference to the position of the train clock 20 shown in FIGS. 1 and 2, which is the preferred directional orientation for the primary embodiment of the invention.

It is in accordance with the primary embodiment of the train clock 20 that the car housing members 22, 24, 26 and 28 are directly secured to the base 21 in such manner as to be fixedly attached thereto and immobile since it is not required nor desired that the car housings move during the clock timing operations of the train clock 20. The intercar couplings 30 are preferably fixed and non-detachable as between the car housings 24 to 26 and 26 to 28, but the motor car coupler means 31 is detachable in order to provide that the engine car 22 can be removed from the base 21 providing access to an interiorly mountable electric clock motor 42 (FIG. 3) and access to a rotatable clock shaft 44 through the adjustable motor car coupler means 31 as will be more particularly set forth hereinafter. The particular design depicted for the housing enclosure of the train clock 20 is not to be considered to comprise a part of the novel utility of the present invention apart from the selected groupings and provision of outer side wall housing apertures 46 for the coal car housing 24, housing apertures 48 for the first passenger car housing 26 and housing apertures 50 for the second passenger car housing 28, respectively. It is noted that other equally suitable housing enclosure designs and configurations could be utilized as well without departing from the novel clock timing, utility and mechanical functioning of this invention.

FIG. 3 shows one manner of mounting the electric clock motor 42 wherein the motor 42 is securable to base supported post-like members 51 and 53 through the use of standard fastener devices 52 and 54, respectively. The clock motor 42 comprises timing source means and is generally a 60 cycle synchronous AC motor having a driven rotatable terminal shaft or post 55 by which to drive a variety of connectable clock timing mechanisms. The preferred clock motor 42 provides one-fifth revolution (cycle) per minute so that the driven terminal shaft 55 completes one-fifth of a complete 360 degree revolution with each 60 seconds of elapsed time, that is, one complete 360 degree revolution each 5 minutes. The clock motor 42 is suitably provided with a line cord 56 comprising AC line connection means. The engine car housing 22 is shown to be removeable from the base 21 wherein it normally covers the clock motor 42. The engine car 22 defines an interior rear cavity or compartment (not shown in the drawing) into which the clock motor 42 is desirably received during the in-place positioning of the housing 22 upon the base 21. The rear wall 37 of the engine car 22 defines an opening 56 therein which opens into communication with the interior clock motor compartment. The drive shaft 55 protrudes through the opening 56 with the engine car housing 22 mounted upon the base 21 and the clock motor 42 received within the interior compartment of the housing 22.

A pair of base supported guide posts 57 are provided forwardly of the post members 51 and 53, which guide posts are intended to cooperate in fitting with the engine housing 22 during the lowering thereof into proper position on the base 21, and also to provide correct orientation of the housing 22 on the base 21. An alternative base mounting provision for the engine housing 22 is to provide a pair of fastener devices, such as elongated screws (not shown) in lieu of the guide posts 57, which screws are insertable through the thickness dimension of the base 21 and then engageable with the engine housing 22. One such engagement could be with the front pair of wheel members 41 for the engine car 22. Further, in order to maximize the access to the detachable coupling means 31 for the purpose and convenience of setting the desired attained time of day through means of rotation of the clock shaft 44, the clock motor 42 can be alternatively and preferably provided with suitable mounting (not shown) within the rear inner compartment of the engine car. In this manner, the removal of the engine car 22 from the base 21 results in the simultaneous removal of the clock motor 42. Such removal, of course, requires the decoupling of the clock shaft 44 from the driven clock shaft 55 through the provision of the coupling means 31.

FIG. 3A shows a preferred embodiment of the coupling means 31 including a pair of cylindrical or wheel members 61 and 63 which interconnect or couple together by means of the protruding tines or fingers 62 extending from an inner face of the wheel member 61 and being insertable or received through aligned apertures 64 defined in the adjacent wheel member 63. The wheel member 61 is interconnected or joined to an axially aligned and protruding block member 65 which is generally tubular on at least the distal free end portion thereof in order to provide means for the telescopic insertion of the driven clock shaft 55 therein. The wheel member 63 is to be secured to the adjacent terminal end portion of the rotatable clock shaft 44, and the driven rotational movement of the shaft 55 provides corresponding and direct proportioned rotational movement of the clock shaft 44. With the engine car 22 removed from the base 21 and the clock motor 42 decoupled from the clock shaft 44, the wheel member 63 can be grasped and hand-rotated until the desired time of day reading is provided through visual indications of the train clock 20, as will be more clearly understood after a thorough consideration of the following description.

An alternative embodiment of the coupling means 31 is shown in FIG. 4 wherein there is provided a single wheel member 67 having a pair of oppositely and axially aligned and extending block members 68 attached thereto. The block members 68 define end wall openings (not shown) in the distal ends thereof which end wall openings are intended to telescopically receive therein both of the linkable shafts 44 and 55 when the clock shaft coupling is completed. The wheel member 67 can be moved axially along the shaft 44 toward the coal car 24 to the extent required in order to free or release the inserted shaft 55, whereupon the clock motor 42 and engine car 22 can be removed from the base 21 during the manual procedure for setting of time of day. The single wheel member 67 is then hand-rotated in order to turn the shaft 44 and provide new time of day readings. Other equally suitable configurations could be utilized for the coupling means 31, and it is only required in connection with this invention that a detachable connection or coupling of shafts be provided together with convenient means of hand-rotating the clock motor shaft 44.

FIGS. 4 and 5 show the preferred embodiment of the coal car housing 24 wherein the rear side wall 38 defines a selected grouping or plurality of side wall housing apertures 66 which are transversely or laterally aligned with the selected grouping of housing apertures 46 in the front side wall 36. In accordance with the invention, the train clock 20 is comprised of separably coupled apparatus groupings which function with time-related movements to present predetermined ball-display patterns indicative of time of day in hours and minutes. Time of day readings are made by visually observing a plurality of spheroids 69 displayed within the window-like frame of the several groups of housing apertures 46, 48 and 50, each such group of apertures being associated with time-indicating indicia as shown in FIG. 1. There are provided a plurality of the moveable spheroids or balls 69 corresponding to or equal in number to the number of display housing apertures 46, 48 and 50. The clock apparatus grouping as contained in the coal car 24 is intended to function to present repetitive ball-display patterns of 1–4 minutes. For this purpose, there are provided four of the housing apertures 46, and four of the housing apertures 66. The housing apertures 66 comprise ball loading apertures as contrasted to ball-display apertures 46. The apertures 46 and 66 are defined by the cooperation of vertical rib or frame members 71 against the side walls 36 and 38, respectively, as shown in FIGS. 4 and 5, but various other and equally suitable configurations and structures could be utilized to define the apertures 46 and 66.

An individual sphere or ball unit 69 is insertable through a selected one of the rear side wall apertures 66 to thereafter be retained or stored within the coal car 24. The loaded and retained ball 69 is then caused to be visually displayed within the window-like frame of the aligned one of the front side wall apertures 46 whenever the ball 69 is to be counted in the 1–4 minute ball-display timing. There are provided four of the balls 69 in the coal car 24 which equal the number of housing apertures 46, sometimes hereinafter said to correspond in number to the number of apertures 46. The relative sizes for the openings of the rear side wall and front side wall apertures 66 and 46, respectively, are determined so that the selected diameter size for the ball 69 is readily receivable or loaded through the rear side wall apertures 66 but is not passable through the front side wall apertures 46. The chosen diameter sizes of the balls 69 are relative to the selected dimensions of the car housings and housing wall apertures 46, 48 and 50.

Figure 8:
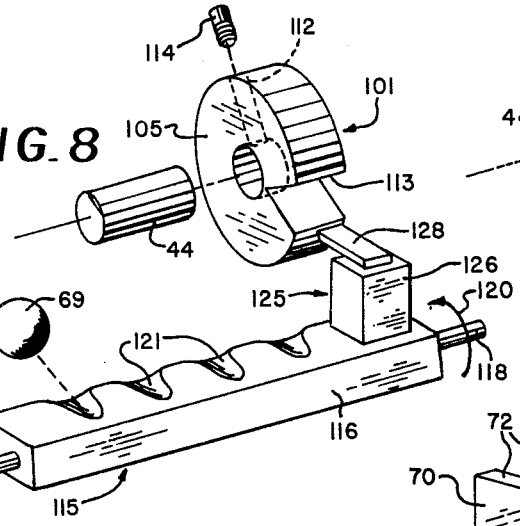
FIG. 8 is a frontal perspective isolated view of the combination of the bar holder means, cam follower means, an individual sphere, sectioned shaft means, and particular cam means.
Figure 9:
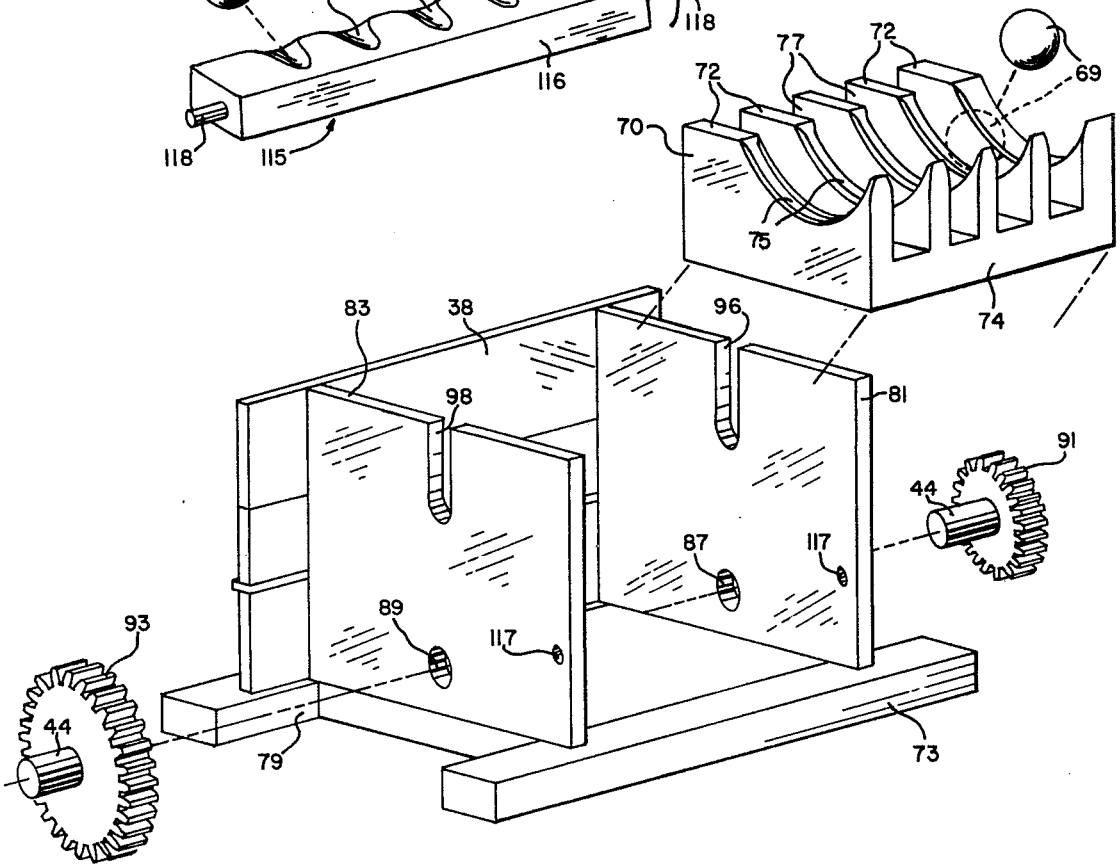
FIG. 9 is a frontal perspective isolated view of the combination of the holder chute means, interior housing structure, an individual sphere, and associated lower gear means.

FIGS. 6–9 show in greater detail the selected apparatus groupings for the coal car 24 wherein the coal car 24 further includes ball-holder chute assembly means in the form of multiple chute or cradle members such as the cradle member 70, as best shown in FIG. 9. The cradle member 70 is intended to be positioned interior to the coal car 24 and supported on parallel spaced lower side frame members or bars 73 and 79. The ball-holder cradle 70 includes a plurality of parallel and vertical cradle walls 72 rising from a base portion 74 of the cradle member 70. Selected portions of the upper surfaces of the cradle walls 72 are removed to define dish-shaped or concave upper surfaces 75, respectively, which surfaces 75 may be slightly raised or ridged centrally along their intermediate sections to define oppositely disposed sloping edge portions therealong (not shown in the drawing). The cradle walls 72 are separated from each other or spaced apart in order to define trough areas 77 therebetween. The balls 69 are to be received into the trough areas 77, respectively, so that the edge portions of the balls 69 engage and are supported by the concave upper surfaces 75 along the adjacent pair of walls 72. It is seen that a selected grouping or plurality of the balls 69 are to be held by the ball-holder cradle 70 in adjacent positions, and the ball-holder cradle 70 can also be referred to as spheroid holder storage means. The particular cradle structure 70, constructed for use in the coal car 24, is comprised of five cradle walls 72 and four trough areas 77 capable of holding four adjacently positioned balls 69. The balls 69 naturally come to rest in the lower extremities of their associated concavical trough areas 77.

The cradle holder 70 is desirably placed into position between a pair of inner wall structures 81 and 83 which are illustratedly supported on the lower frame members 73 and 79 and are parallel spaced from the front and rear end walls 35 and 37, respectively. The inner wall 81 is spaced inwardly from the outer front end wall 35 to define a front housing cavity 82, and the inner wall 83 and the rear end wall 37 are spaced apart to define a rear housing cavity 84. The interior spacing between the two inner walls 81 and 83 comprises a middle or intermediate housing cavity 86, which is the largest of the interior housing cavities 82, 84 and 86. The cradle holder 70 is to be contained in the middle cavity 86, and the front and rear housing cavities 82 and 84, respectively, comprise so-called gear cavities wherein intermeshed gear wheels are rotatably mounted on discontinuous portions of the clock shaft 44. Beginning at the front end wall 35 of the coal car 24, a relatively short portion of the rotatable clock shaft 44 protrudes from the front end wall 35 so as to be engageable with the motor coupling means 31. The opposite shaft end thereof extends through the front housing cavity 82 to be supported within an axially aligned aperture 87 (FIG. 9) located in the lower central extremity of the front inner wall 81.

Gear means in the form of a selected gear wheel 91 is fixedly mounted to the front shaft portion 44. Another relatively short portion of the rotatable clock shaft 44 protrudes rearwardly from the rear end wall 37 so as to be engageable with intercar coupling means 30. The opposite end thereof extends through the rear housing cavity 84 to be supported within an axially aligned aperture 89 (FIG. 9) located in the lower central extremity of the rear inner wall 83. The front and rear portions or segments of the shaft 44 are in axial alignment. Gear means in the form of another selected gear wheel 93 is fixedly mounted to the rear shaft portion 44. The diameter for and number of gear teeth on the lower front and rear gear wheels 91 and 93 are selected in accordance with the geared ratio which is desired to be attained. The lower front and rear gear wheels 91 and 93 are defined herein as gear driver wheels.

As shown in the drawing, the rotatable clock shaft 44 is comprised of an upper elongated shaft portion, also referred to in the drawing as reference numeral 44, which upper shaft portion 44 is linked to the lower front and rear shaft portions 44 through intermeshed gear means comprised of a gear wheel 95 to be intermeshed with the lower front gear wheel 91 and a gear wheel 97 to be intermeshed with the lower rear gear wheel 93. Again, the diameter for and number of gear teeth on the upper front and rear gear wheels 95 and 97 are selected in accordance with the desired geared ratio of rotation between upper and lower shaft portions 44.

The upper shaft portion 44 is rotatably mounted with respect to the coal car housing 24 with the opposite end portions thereof to be received within the pair of apertures 92 and 94 (FIG. 4) located in the central upper regions of the front wall 35 and the rear end wall 37, respectively. The inner walls 81 and 83 are appropriately slotted as noted by slots 96 and 98 (FIG. 9) in order to receive the diameter of an interior section of the upper shaft portion 44. The gear wheels 95 and 97 are to be received into the front and rear housing cavities 82 and 84, respectively, wherein the gear wheels 91 and 95 and the gear wheels 93 and 97 are intermeshed in a conventional manner. The upper front and rear gear wheels 95 and 97 are defined herein as gear follower wheels. It is to be noted that the upper and lower oriented shaft portions 44 are offset in their axial alignments and said to be discontinuous along their elongated axis of rotation, although, generally speaking, the several shaft portions 44 comprise one continuous rotatable drive shaft means. This manner of configuration for the clock drive shaft portions 44 is intended to provide for the insertion of the gear means whereby several different geared ratios of shaft rotation can be achieved. The geared ratios for drive shaft rotation are different for each of the car housings 24, 26 and 28, as shall be more fully understood in the continuation of this description.

In accordance with the invention, driver cam means 100 in the form of a plurality of driver cam members 103 and timing cam means 101 are provided in combination with the rotatable shaft 44 to comprise time referenced (ball) loading means for loading the spheroids 69 on to the holder bar 116 with predetermined time reference motion controlled by the timing source means and the selected gear ratios. Hence, the cams 103 are provided to remove the plurality of balls 69 from the ball-holder cradle 70 with controlled time-related movements, and thereby to cause the balls 69 to be visually and individually displayed (in response to elapsed time) within the window-like frames of associated time-indicating apertures 46, 48 or 50. To this end, the driver cam members 103 are fixedly mounted to and spaced adjacently along the intermediate length of the upper shaft portion 44. The number of driver cam members 103 are generally equal to the number of balls 69, with one exception to be noted hereinafter. In connection with the preferred configuration of clock apparatus to be associated with the coal car 24, there are four such individual driver cam members 103. The timing cam means 101 is configured in the form of an individual cam member 105 to be mounted on the upper shaft portion 44 in axial alignment with and adjacent to the plurality of driver cam members 103.

Figure 7:
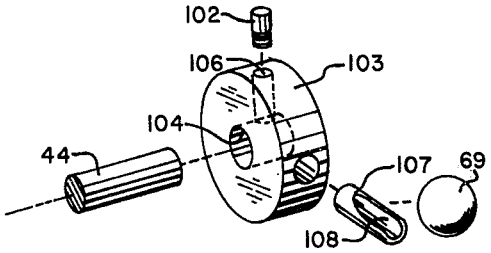
FIG. 7 is a frontal perspective isolated view of an individual one of a plurality of cam members as shown in FIGS. 4 and 6.

FIG. 7 particularly shows the preferred detailed embodiment of an individual driver cam 103 wherein the cam member 103 is generally tubular with a central axial opening 104 through which the shaft 44 is insertable in order to mount the driver cams 103 therealong. A fractional segment of the shaft 44 is shown in FIG. 7 in aligned insertable position with respect to the central axial opening 104 of the depicted driver cam member 103. The cam 103 is mounted to the shaft 44 by fastener means in the form of a recessable set-screw 102 to be received within an appropriate opening 106 providing access to the shaft 44. If desired, another and oppositely disposed shaft access opening (not shown) can be provided in order to reinforce the singular shaft mounting provision of the single set-screw 102.

Protrusion members or tines 107 are associated with the driver cam members 103, respectively, with a singular protruding arm or tine 107 being recessedly mounted within the circumferential edge portion of an associated driver cam 103. The arm or tine 107 protrudes a predetermined distance from the driver cam 103, and may be configured to present a scooped surface 108 which enhances solid engagement with an aligned ball 69 for moving or driving the ball 69 from an associated one of the underlying concavical trough areas 77 of the ball-holder cradle means 70. It is to be noted that the cam members 103 are mounted on the clock shaft 44 with their arms 107 extending at right angles outwardly therefrom. The cam members 103 are turned or rotated about this shaft 44 with respect to each other so that the arms 107 of adjacent pairs of the cams 103 are said to be angularly separated. The cam members 103 of FIG. 6 to be used in the coal car 24 have adjacent pairs of tines 107 separated by an angular rotation of 72 degrees with reference to a 360 degree complete rotation around the axial center of the clock shaft 44. In this angular orientation for the mounted cams 103, the continuous time-related rotation of the clock shaft 44 precipitates corresponding continuous time-related rotation of the cams 103, and corresponding time-related movements of the balls 69. Beginning with a zero-degree angular timing reference point, the continued rotation of the clock shaft 44 provides the removal of an aligned ball 69 from its associated holder cradle 70 with each and every occurring 72 degrees of angular rotation of the clock shaft 44. As will be described more fully hereinafter, the geared ratio of the intermeshed gear means (gear pairs 91 to 95, etc.) provides that a ball 69 is to be removed from the holder cradle 70 with the occurrence of each one minute (60 seconds) of elapsed time.

As shown most clearly in FIGS. 4, 5 and 8, spheroid holder display means 115 in the form of a pivotable elongated holder bar member 116 comprises an integral part of the apparatus grouping in the coal car 24. The holder bar member 116 is generally configured to be bar-shaped in cross-section with its relative thickness being less in dimension than its relative width, and having a pair of protruding pins 118 attached to the end wall portions, respectively, in order to provide that the holder bar 116 has a pivot axis about its elongated dimension. It is preferred to offset the pivot axis from the true centered elongated axis so that the center of mass for the holder bar 116 is placed off-center; thus, the holder bar 116 will have a free rotational bias about its pivot axis in the direction of the arrow 120 with reference to the orientation shown in FIG. 8. The pivotable holder bar 116 is moveable between a first stable position thereof wherein the bar 116 has its upper surface aligned to receive and hold spheroids 69 loaded thereon, and a second stable position thereof wherein the bar 116 has its upper surface tilted in alignment with the associated trough areas 77 to unload or dump the displayed spheroids into the aligned trough areas 77.

The upper or top surface of the holder bar 116 is shallowly recessed or dished in four areas 121 whereon it is intended to mount or place the four balls 69 at rest for visual framed display through the time indicator apertures 46. The added weight of the balls 69 upon the bar 116 provides added torque of rotational bias to the free movement of the bar 116. In a suggested mounting configuration, the pivotable holder bar 116 is mounted in the coal car 24 so that its pivot pins 118 are receivable through the aligned apertures 117 which are provided in the inner walls 81 and 83. The holder bar 116 is placed directly adjacent to the several trough areas 77 of the holder cradle 70 so that upon the movement of the stored balls 69 from their respective trough areas 77 as in correspondence to the time-related rotation of the driver cam members 103, the balls 69 are driven by engagement with the arms 107 to be loaded or deposited for time-indicating display onto the holder bar 116, coming to rest in the dished areas 121, respectively.

The holder bar 116 is prevented or restrained from free rotation about the pivot pins 118 by the provision of means for biasing the spheroid holder display means 116 to maintain its first or ball display position in response to first selected movement of the timing cam means 101. The means for biasing the holder bar 116 is comprised of cam follower means 125 embodied in the form of a mounting block 126 used in combination with a protruding relatively inflexible wiper tine or finger 128, and is further comprised of an associated timing cam 105. The block 126 is preferably secured to one end portion of the upper surface of the holder bar 116, and the wiper tine 128 is preferably secured to the upper surface of the mounting block 126 so as to extend perpendicular to the clock shaft 44 in a direction inwardly of the intermediate housing cavity 86. The distal or free end portion of the wiper tine 128 is engageable with or wipes against the outer circumferential surface of the timing cam 105. It is apparent that this engagement with the timing cam 105 will provide rotational restraint and stability for the holder bar 116 so long as the timing cam 105 presents a circular outer surface of uniform radius.

As has been previously noted, the timing cam 105 is mountable to the clock shaft 44, as indicated by the axially aligned segment of shaft 44 shown in FIG. 8, and is fixed on the shaft 44 by identical mounting provisions as are utilized for the driver cam members 103, such as an aperture 112 and an insertable set-screw 114. Now, the noted outer surface of the timing cam 105 is selectively recessed to provide or define a recessed trough or valley area 113. The time-related rotation of the clock shaft 44 causes the recessed area 113 to be presented to the contact of the wiper tine 128 once with each complete revolution of the timing cam 105. The depth of the recessed area 113 determines the permitted axial rotation or pivot of the holder bar 116 in the direction of the arrow 120, and the width of the recessed area 113 is determinative of the amount of time elapsed during the complete pivoting cycle of the holder bar 116 from its aforesaid first pivot position to the second pivot position and then back to the first pivot position.

It is desired to provide a relatively steep sided recessed area 113 in order to provide for a definite and quickened inward rotation upon the release of the holder bar 116. The inward rotation of the holder bar 116 has the immediate effect of dumping or dropping the so-called loaded balls 69 from their formerly stable display positions within the shallow dished areas 121. The direction of movement for the unloaded balls 69 is inwardly of the housing cavity 86 in correspondence to the direction of rotation for the holder bar 116. The preferred elevational mounting of the holder bar 116 provides that the upper surface of the bar 116 is slightly overlying and adjacent to the aligned trough areas 77 of the holder cradle 70. Hence, the dumped or dropped balls 69 are to be received directly into the aligned trough areas 77, respectively. It is to be noted that the provision of offsetting the rotational pivot axis of the holder bar 116 from the true center of its elongated pivot axis has the effect of providing that the added weight of the balls 69 will quicken the rotational movement of the holder bar 116 to its second pivot position. The weight of the loaded balls 69, therefore, comprise means for counter-biasing the spheroid holder display means 116 to move to this second pivot position in response to second selected movement of the timing cam means 101 whereby the recessed area 113 is aligned with the wiper tine 128 of the cam follower means 125.

In summary of the mechanical timing and apparatus grouping as provided within the coal car 24, there are provided in combination the discontinuous horizontally aligned clock shaft portions 44 including lower front and rear shaft portions and an upper shaft portion thereof, intermeshed gear means including the intermeshed gear pairs 91 and 95 and the gear pair 93 and 97, timing cam means 101 provided by the cam member 105, driver cam means 100 provided by four driver cam members 103, the holder cradle 70 with four trough areas 77, four balls 69 resting in the trough areas 77, respectively, the pivotable holder bar 116 with the associated cam follower means 125, and the intercar coupling means 30. The clock shaft 44 is coupled to the driven terminal shaft 55 of the clock motor 42 through the coupling means 31. With a one to one coupling ratio therebetween, a complete revolution of the clock shaft 44 corresponds to a complete revolution (1/5 rpm) of the clock motor 42. The clock motor 42 is selected to provide one complete revolution for each five (5) minutes of elapsed time; however, it should be apparent that other rated rpm clock timing sources could be utilized as well provided that properly matched geared ratios were also utilized and adapted for the rotational movement of the tines 107 of the driver cams 103 and the rotational movement of the timing cam 105.

Figure 6:
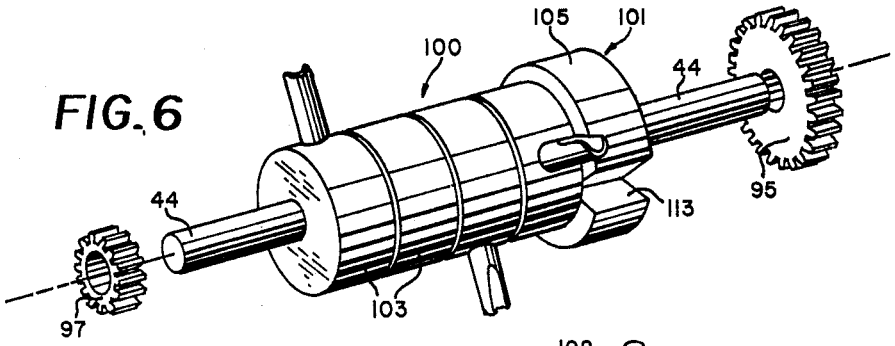
FIG. 6 is a frontal perspective view of the combined cam means and rotatable shaft means as used within the coal car housing and showing associated upper gear means.

Now, beginning with a zero-degree angular timing shaft reference point corresponding to or marking the completion of a first 5 minute increment and the initiation of a second 5 minute increment of time, the revolving rotational movements of the shaft 44 through a 72 degree rotation will provide (through the rotational movement of the first or right-most cam 103 as viewed in FIG. 6) the deposit of one of a first aligned ball 69 onto the holder bar 116 whereupon the first ball 69 is visually displayed within the closely adjacent associated window of the time-indicating housing apertures 46. The elapsed time for such shaft rotation is one minute (60 seconds). Another 72 degrees of shaft rotation, totaling 144 degrees from zero-reference point thereof, provides through the movement of the second and next-adjacent cam 103 (moving leftward in FIG. 6), the deposit of another or a second ball 69 onto the holder bar 116 whereupon the second ball 69 is then visually displayed within an associated and adjacent window of the time-indicating apertures 46. A further 72 degrees of shaft rotation, totaling 216 degrees from the zero-reference point, results through the movement of the third and next-order adjacent cam 103, in the deposit of still another or a third ball 69 onto the holder bar 116 whereupon the third ball 69 is then visually displayed within an associated and adjacent window of the time-indicating apertures 46. A still further 72 degrees of shaft rotation, results through the movement of the fourth and next-order adjacent cam 103 in the deposit of yet another or fourth ball 69 onto the holder bar 116 whereupon the fourth ball 69 is additionally displayed within an associated and adjacent window of the time-indicating apertues 46.

The time-indicating apertures 46 now display four accumulated balls 69 indicative of 4 minutes of elapsed or attained time of day. Yet still a further 72 degrees of shaft rotation to bring the shaft through a full 360 degrees of rotation, results in the simultaneous redeposit or dumping of the four accumulated balls 69 back onto the holder cradle 70 when the continuous revolving of the timing cam 105 causes the recessed area 113 to be presented to the cam follower means 125 of the spherical holder means 115. The apertures 46 then display none of the formerly accumulated balls 69, and the absence thereof is indicative of 5 minutes of elapsed or attained time of day. As will be described hereinafter, the 5 minute indication is provided by the generally simultaneous appearance or presence of a selected ball-pattern display in one of the apertures 48 of the first passenger car 26.

Figure 10:
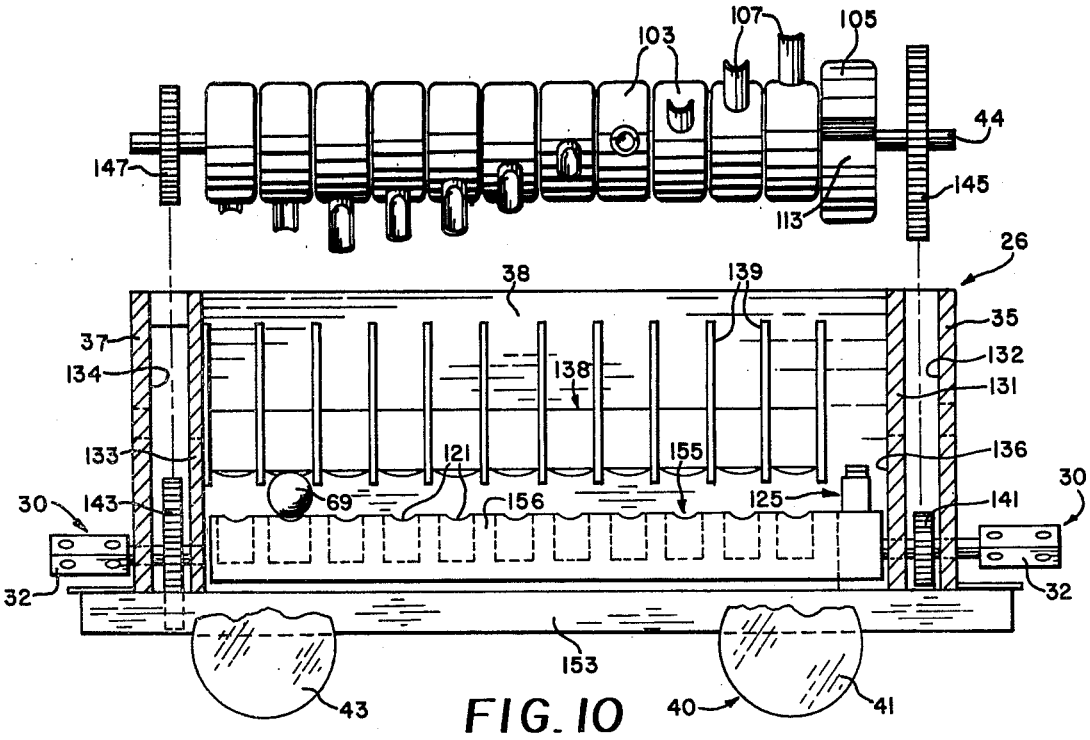
FIG. 10 is a partially sectioned right side view of a first passenger car housing very similar to the showing of FIG. 4.
Figure 11:
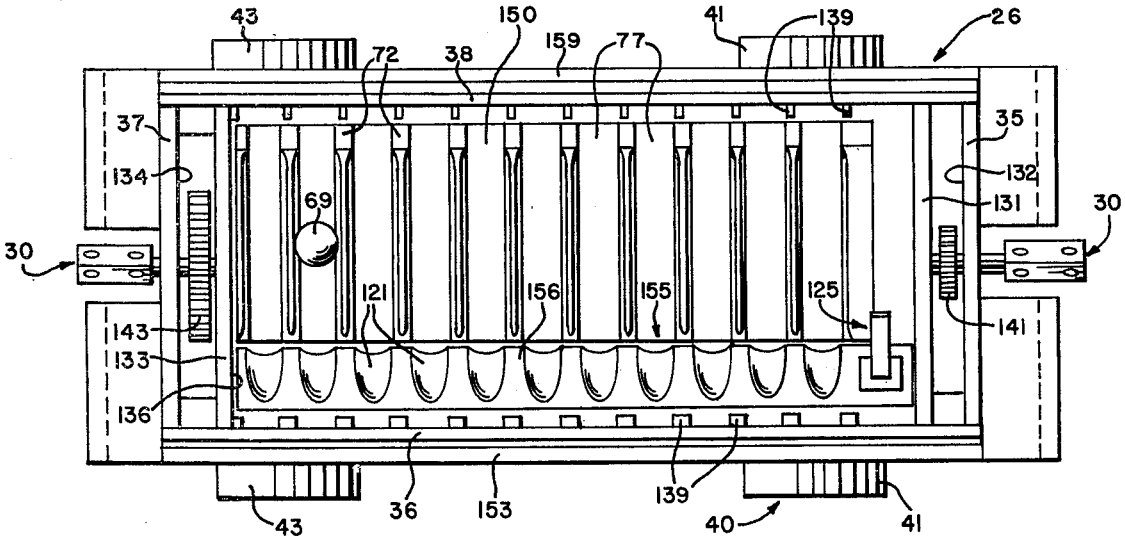
FIG. 11 is generally a top view of the first passenger car housing as shown in FIG. 10, and being very similar to the showing of FIG. 5.
Figure 12:
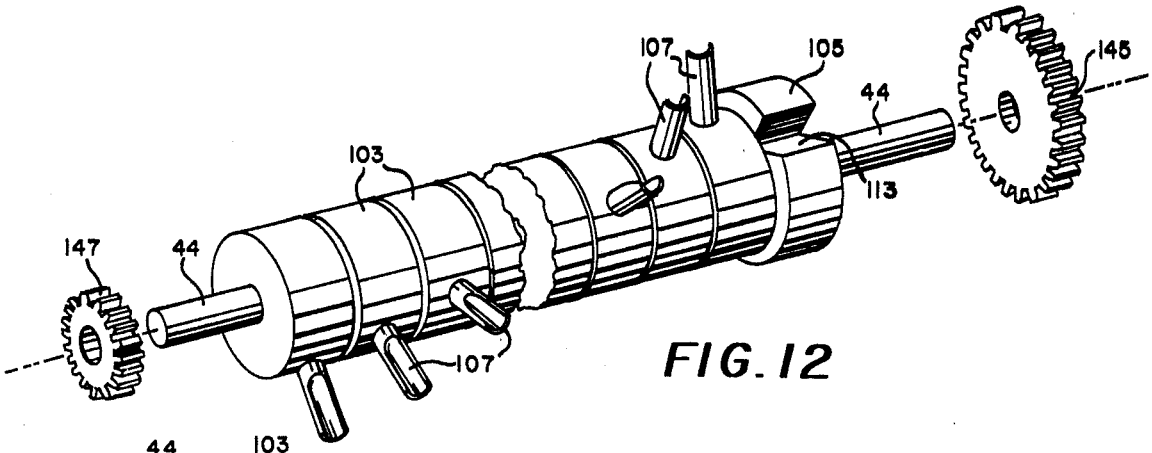
FIG. 12 is a broken frontal perspective view of the combined cam means and rotatable shaft means as used within the first passenger car housing and showing associated upper gear means similar to FIG. 6.

As shown in the drawing, the car housing 24 and 26 are directly coupled on a one-to-one (1—1) ratio through provision of intercar coupling means 30 which is more particularly configured as an apertured block 32 fixedly mounted to adjacently placed terminal end portions of clock shaft 44 in order to link the car housings 24 and 26. The car housings 26 and 28 are also interconnected with the use of the identically configured apertured block 32, but it is apparent that other equally suitable configurations of fixed coupling means 30 could be provided. FIGS. 10–12 show the preferred embodiment of the clock apparatus grouping for the first passenger car 26 for which the structural parts and/or members are generally identical to those numbered parts and/or members as have been described in connection with the coal car 24, except as to differences in the numbers of apertures 48 and driver cam members 103, the number of trough areas 77 for the holder cradle 70, the number of dished areas 121 on the pivotable spherical holder bar 116, and a difference in the selected geared ratio for the intermeshed gear pairs. Due to the close similarity of parts and timing operation and in the interest of brevity without expense to the thoroughness of explanation of the present invention, somewhat less of a detailed explanation will be given now in connection with the apparatus groupings for the car housings 26 and 28.

The clock apparatus grouping to be contained in the first passenger car 26 is intended to present repetitive ball-display patterns of 5–55 minute increments. The passenger car housing 26 is comprised of three interior housing cavities or openings, to wit: a front-oriented cavity 132, a rear-oriented cavity 134 and a middle larger cavity 136. The parallel spaced front end wall 35 and the front-oriented inner wall 131 define the front housing cavity 132, and the parallel spaced rear end wall 37 and the rear-oriented inner wall 133 define the rear housing cavity 134. The spacing between the inner walls 131 and 133 define the middle housing cavity 136. The car housing 26 includes the front side wall 36 having display window-like apertures therein previously described as the aperture grouping 48. There are provided eleven of the display housing apertures 48. The rear side wall 38 of the car housing 26 also includes a like plurality of loading window-like apertures therein, shown at 138 in FIG. 10, and at least partially defined by vertical frame members 139 spaced along the rear side wall 38. There are provided eleven of the loading housing apertures 138. There are further provided lower front and rear shaft portions 44 rotatably supported by the parallel spaced walls 35, 131 and 37, 133, respectively, and an upper shaft portion 44 of FIG. 12 which is also rotatably supported by the walls 35, 131 and 37, 133. The lower front and rear shaft portions 44 are co-axially aligned and the upper shaft portion 44 extends in horizontal parallel axial alignment therewith. The separable shaft portions 44 are joined for simultaneous rotation through intermeshed gear means comprised of front-oriented gear pair 141, 145 contained in the front housing cavity 132 and rear-oriented gear pair 143, 147 contained in the rear housing cavity 134. The relative shaft rotations between the separable shaft portions 44 are determined by predetermined geared ratios for the gear pairs 141, 145 and 143,147.

The passenger car housing 26 further includes spheroid holder display means in the form of the ball holder cradle 150 which is identically configured to the holder cradle 70 of FIG. 9, except that the number of vertical adjacent cradle walls 72 are twelve and there are one less number of concavical trough areas 77 therefor. There are eleven balls 69 to be mounted at rest on the holder cradle 150. There are eleven of the driver cam members 103 mounted along the upper shaft portion 44 for the car housing 26, and a single timing cam 105. The driver cam members 103 and the timing cam 105 are shown in detail in FIG. 12 and are identical in configuration and mounting to those shown in connection with the car housing 24, except that adjacent pairs of the protruding tines 107 are rotationally offset by only 30 degrees of angular rotation with respect to each other, in comparison to the 72 degree rotationally offset of the cam members 103 or the car housing 24. The intermediate portion of the assembly of cam members 103 has been broken for avoiding undue complexity of the illustration thereof. The car housing 26 includes framing means having at least parallel spaced lower side frame members 153 and 159. There is also provided ball-holder chute assembly means 155 in the form of a pivotable elongated bar member 156 which is identical in configuration to the holder bar 116 of FIG. 8, except that the number of dished areas 121 are twelve instead of four. The cam follower means 125 is identical in configuration and operation to that item 125 shown and described in connection with the coal car 24. A ball 69 is shown in FIG. 10 at rest upon the pivotable bar member 156 within a dished area 121, and in FIG. 11 a different ball 69 is shown to be at rest in one of the trough areas 77 of the holder cradle 150.

In explanation of the timing function of the apparatus grouping of the first passenger car 26, there are eleven adjacent and continuously aligned balls 69 mounted at rest on the holder cradle 150 as the shaft rotational position corresponds to the aforementioned zero-degree angular timing shaft reference point. The geared ratios of the gear pairs 93, 97 and 141, 145 are such as to provide one complete revolution of the upper shaft portion 44 of the second car 26 for each one hour (60 minutes) of elapsed or attained time of day. The angular separations of adjacent pairs of the tines 107 are such as to provide one additional ball 69 to be deposited on the adjacent holder bar 156 for each five minutes of elapsed time and for all previously deposited balls 69 to be redeposited onto the holder cradle 150 with the attaining of one hour (60 minutes) of elapsed time. When the movement of balls 69 into framed alignment with the time-indicating apertures 46 within the coal car 24 is completed and four minutes of elapsed time are indicated by the count of the visually displayed balls 69, the continued rotational movement of the coupled clock motor 42 will thereafter cause the redeposit of the balls 69 into the associated holder cradle 70, together with the generally simultaneous deposit of a first ball 69 within a 5 minute indicating aperture 48 of the car housing 26. The complete 360 degree rotational cycle of the upper shaft portion 44 of the coal car 24 has been mechanically translated by selected gear ratios to a 30 degree shaft rotation for the upper shaft portion 44 of the first passenger car 26. The cycle is repeated to subsequently deposit the remaining ten balls 69 of the car 26 into five-minute incremented visual ball-display patterns within the time-indicating apertures 48. Upon completion of 360 degree rotation of the upper shaft portion 44 of the car 26, the timing cam 105 will present its recessed area 113 to the cam follower means 125 of the holder bar 156, and the eleven previously displayed balls 69 will be dumped or redeposited onto the adjacent holder cradle 150.

Figure 13:
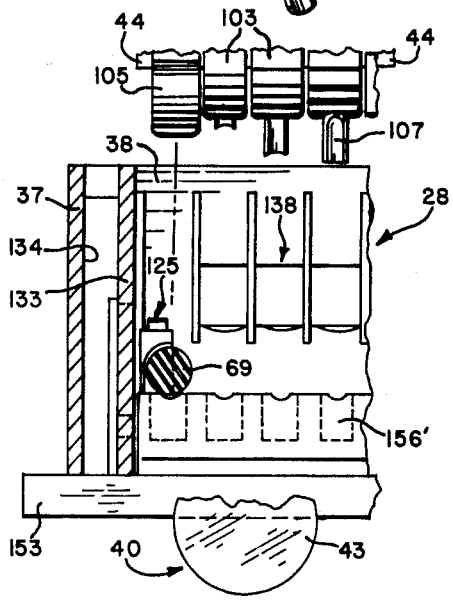
FIG. 13 is a partial broken and sectioned right side view of the rear-most portion of a second passenger car housing showing a broken section of cam means and rotatable shaft means removed therefrom, an apertured rear housing wall and pivotable bar holder means.
Figure 14:
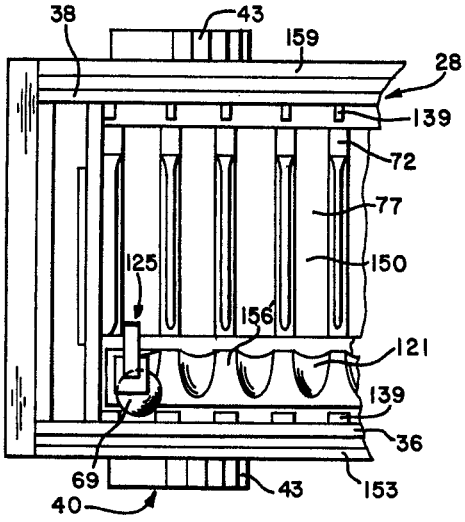
FIG. 14 is a partial broken top view of the rear section of the second passenger car housing as was shown in FIG. 13.

The first passenger car 26 is directly coupled on a 3–1 gear ratio through the intercar coupling means 30 to the second passenger car 28. The clock apparatus grouping to be contained within the second passenger car 28 presents repetitive ball-display patterns of 1–12 hours in one-hour increments. FIGS. 13 and 14 show the preferred embodiment of the clock apparatus grouping for the car 28 for which the structural parts and/or members are generally identical to those numbered parts and/or members as have been heretofore described, except to state that there are twelve of the window-like apertures 50 in the front side wall 36 thereof and only eleven of the window-like apertures 138 in the rear side wall 38 thereof. Only the rear-most fractional part of the passenger car 28 is shown in the FIGS. 13 and 14 since the configuration thereof is practically identical to that of the car 26, as was described in connection with the FIGS. 10–12, except for the differences now particularly described. The detailed description hereof has been desirably shortened by the use of like-numbers for reference numerals in those instances where the part is the identical part in both car housings 26 and 28. Hence, the holder cradle 150 is utilized in the car 28 since eleven balls 69 are moveable and the twelfth ball 69 is fixed into continuous visual time-indicating display. However, the holder bar 156 of the car 26 must be elongated to hold twelve balls 69 for visual display, and an elongated holder bar 156' is shown in FIGS. 13 and 14, wherein the primed reference numeral is indicative of no structural change from the holder bar 156 except for the length dimension thereof.

Another slight structural difference in the apparatus grouping of the car 28 is noted in that the rear housing cavity 134 does not include intermeshed gear means, any rear shaft portion 44 or the intercar coupler means 30 since the car 28 is the rear-most car of the train assembly 20. Further, it is convenient to provide that the timing cam 105 and the associated cam follower 125 shall be positioned on the terminal ends of the upper shaft portion 44 and pivotable holder bar 156', respectively. (The primed reference numeral is used to indicate an identical part to that part bearing the same unprimed reference numeral). The end-positioned ball 69 as shown in FIGS. 13 and 14 is provided to be stationary and fixed with respect to its visual display position on the holder bar 156'. The pivotal movement of the holder bar 156' does not result in the dumping of the stationary and twelfth ball 69. The stationary ball 69 can be suitably secured to the front of the cam follower means 125, or other suitable means for securing the stationary ball 69 could be used as well.

In accordance with the preferred timing of the apparatus grouping of the terminal car 28, there are provided eleven balls 69 aligned at rest on the holder cradle 150, and the geared ratios of the gear pairs 143, 147 and a front pair of gears in the terminal car 28 (not shown in the drawing), which are provided in the same manner as are the front gear pair 141, 145, are then deisgned to provide one complete revolution of the upper shaft portion 44 of the terminal car 28 for each 12 hours (720 minutes) of elapsed time. For example, with each completed 360 degree shaft rotation for the first passenger car 26, the intercoupled upper shaft portion 44 of the second passenger car 28 will be caused to rotate through an angular rotation of 30 degrees and a ball 69 will be deposited within the associated time-indicating aperture of the aperture grouping 50. The cycle is repeated to subsequently deposit the remaining ten moveable balls 69 of the car 28 into one-hour incremented visual ball-display patterns within the time-indicating apertures 50. It is to be noted that the first moveable ball 69 to be deposited for visual display will correspond to the second hour of elapsed time as the first hour indication for elapsed time is accomplished by means of the fixed or stationary ball 69. The eleventh moveable ball 69 to be deposited for visual display will correspond to the twelfth hour of elapsed time, and upon the expiration of twelve hours and fifty-nine minutes, all of the time-indicating apertures 46, 48 and 50 will be visually displaying a framed ball 69. Further, shaft rotations of 72 degrees for the shaft 44 of the coal car 24, 6 degrees for the shaft 44 of the first passenger car 26, and 0.5 degrees for the shaft 44 of the second passenger car 28 will result from one minute of additional elapsed time, precipitating the simultaneous dumping of all displayed balls 69, except for the fixed one-hour indicating ball 69, in a direction rearwardly into the associated holder cradles 70 and 150. The simultaneous dump of the displayed balls 69 of the passenger car 28 is therefore accomplished at the attainment of the 1:00 time reading as shown in FIG. 15.

In another preferred embodiment of the invention, the various apparatus groupings as contained within the intercoupled railway cars 22, 24, 26 and 28 could as well be alternatively arranged within a singular non-coupling housing enclosure (not shown in the drawing) to present a vertical stacked relationship to each other in lieu of the horizontally aligned apparatus arrangement heretofore described in connection with the employment of the coupled train assembly of housing enclosures 20. One other such suggested singular housing enclosure is a simulated boat enclosure with side wall apertures (not shown). Still another singular housing enclosure is a simulated building enclosure with side wall apertures (again, not deemed necessary to show in the drawing). It is readily apparent that many other equally suitable housing enclosures could be selected in which the alternative vertical apparatus arrangement could be employed. It is thought herein in connection with this detailed description to require only a rather brief illustration of a suggested manner in which such vertical apparatus intercouplings could be provided. The brief illustration of a vertical apparatus grouping is largely restricted in the drawing to visual demonstration of a vertically arranged grouping of time-indicating apertures representing time increments of 1–12 hours, 5–55 minutes and 1–4 minutes.

FIG. 15 shows a suggested alternative vertically stacked embodiment wherein a total aperture grouping 170 consists of a first level of time-indicating apertures 171 which are provided to display attained time of day in hours 1 through 12, a second or middle vertical level of such apertures 173 as provided to display attained time of day in five minute increments of 5–55 minutes, and a third or upper vertical level of such apertures 175 which are provided to display attained time of day in one minute increments of 1–4 minutes. Thus, there are four of the group of apertures 175, eleven of the group of apertures 173 and twelve of the group of apertures 171. The shaft portions 44 for the first, second and third vertical levels correspond to the shaft portions 44 for the cars 28, 26 and 24, respectively, and the shaft portion 44 for the third vertical level is shown coupled to a shaft 181 of a typical electric clock motor 182, as through the use of direct couplers 183. The different vertical levels are coupled by belts 185 and pulleys 187, 189, 191 and 193.

It should be readily apparent to the reader that the alternative housing enclosures would be provided with means for supportingly mounting the apparatus groupings in the suggested vertically stacked configuration, and that the apparatus groupings have been previously described in connection with the train housing assembly 20. The selection of proper spacing, connections and dimensions for such vertical stacking of clock apparatus groups is well within the choice and ability of the skilled practitioner of the pertinent art field, after having read the detailed description of the train clock assembly 20, and the description herein purposely omits such a further detailed description of apparatus.

FIG. 16 is intended to be merely illustrative of the use of any alternative housing enclosures wherein the rear apertured side wall thereof, shown as 201, which is used to provide spheroid access to the interior holder cradles 70 and 150, is spacially separated or removed from the holder cradles 70 and 150. There is then required to be provided ramp means 205 having dished chute areas 206 which are intended to receive the balls 69 upon their insertion through selected apertures 209. The ramp means 205 are inclined downwardly in the direction of the adjacent holder cradle 70. A ball 69 placed thereon through an apertures 209 will be transmitted through gravitational force downwardly along the chute area 206 to be received into the associated trough area 77 of the holder cradle 70. The particular structure of the ramp means 205 is clearly only one such illustrative embodiment and it should be understood that other equally suitable and alternative structures and configurations could be utilized as well, and that the present invention is not limited to the particular structures thereof as shown in the drawing. The apparatus groupings of the railway cars 22, 24, 26 and 28 are clearly functionally independent of their being aligned with respect to each other either horizontally or vertically so long as the proper framing support is provided, and the intermeshed shaft portions 44 thereof are intercoupled with the appropriate geared ratios as explained herein.

While the present invention has been shown and described with reference to the preferred embodiments thereof, the invention is not limited to the precise forms set forth herein, and various modifications and changes may be made without departing from the spirit and scope thereof.

What is claimed is:

1. A clock apparatus including in combination housing enclosure means having outer wall portions defining selected aligned groups of apertures therein, time of date indicia associated with said groups of apertures and providing time-indicating references relative to the positions of said apertures, a plurality of moveable spheroids, timing source means, rotatable drive shaft means mounted in the housing enclosure means, coupling means for coupling the drive shaft means to the timing source means for providing predetermined time-referenced motion to the rotatable drive shaft means, cam means mounted in time-referenced angular loading positions on the rotatable drive shaft means, first spheroid holder means comprising chute assembly means for receiving and storing spheroids thereon in positional relationship corresponding to the selected aligned groups of apertures, second spheroid holder means comprising spheroid display means pivotable between first and second positions and positioned intermediately of and adjacent to the chute assembly means and the selected groups of apertures, said first position of the spheroid display means being aligned to receive spheroids thereon for framed display within the groups of apertures, respectively, and the second position thereof being aligned to depart spheroids therefrom for return to the chute assembly means, cam follower means mounted on the spheroid display means for biasing said spheroid display means to remain in the first position thereof in response to a selected time-referenced loading angular position of the cam means, said cam follower means being responsive to the rotational movement of said cam means to selectively allow for releasing the pivotable spheroid display means from said first position so that it pivots to the second position thereof, and said spheroids being selectively moved into framed display position on the spheroid display means in response to the driven movement of the cam means mounted on the rotatable drive shaft means, and thereafter being selectively removed therefrom when said cam follower means allows for the selective pivoting of the spheroid display means to the second position thereof whereby the spheroids are indicative of attained time of day.

2. A clock apparatus including in combination housing enclosure means having an outer wall defining window-like apertures therein, time of day indicia provided in time-indicating referenced association with the apertures, a plurality of moveable spheroids each of said spheroids associated with a separate one of said window-like apertures, chute assembly means supported in the housing enclosure means for holding the moveable spheroids in stored non-time indicating positions out of framed alignment with associated apertures, said chute assembly means comprising a plurality of parallel spaced apart vertical wall members having their upper surfaces recessed to define concavical trough areas lying betwen adjacent pairs of vertical walls members, and the moveable spheroids are stored in the non-time indicating positions in the concavical trough areas, spheroid holder display means moveable between first positions thereof aligned to receive and hold spheroids positioned thereon in framed alignment with associated apertures, and second positions thereof aligned to return the spheroids to the chute assembly means, the spheroids being positioned to rest on the spheroid holder display means in framed alignment with associated apertures to indicate attained time of day, time-referenced loading means for loading with predetermined time referenced motion thereof the spheroids from the chute assembly means on to the spheroid holder display means, said time-referenced loading means to be moved in response to a timing source means, said time-referenced loading means comprising rotatable drive shaft means supported in the housing enclosure means and being driven through detachable coupling to said timing source means, and cam means mounted on the drive shaft means and rotatable therewith for selectively engaging and moving the spheroids on to the spheroid holder display means with predetermined time-reference motion thereof determined by the timing source means and the detachable coupling thereto, said cam means comprising a plurality of cam members mounted on the drive shaft means, each cam member being generally cylindrical and having an outer circumferential edge surface providing a first section of irregular radius defining protrusion means thereon, said protrusion means being aligned to engage with and move an associated spheroid held by the chute assembly means in stored non-time indicating position, and said engagement with the associated spheroid continuing to move the spheroid in timed relationship to the rotation of the individual cam member mounted on the drive shaft means, first means for biasing the spheroid holder display means to remain in the first position thereof in response to first predetermined movements of the loading means, and second means for counter-biasing the spheroid holder display means to move to the second position thereof in response to second predetermined movements of the loading means.

3. The clock apparatus of claim 2 wherein adjacent pairs of cam members have the protrusion means thereof separated by predetermined angular rotations about the pivot axis of the drive shaft means for providing time correlated predetermined engagements with and movements of the associated spheroids by the pairs of cam members, respectively.

4. The clock apparatus of claim 3 wherein selected adjacent pairs of cam members have their protrusion means separated by angular rotations of 72 degrees and selected other adjacent pairs of cam members have their protrusion means separated by angular rotations of 30 degrees.

5. The clock apparatus of claim 2 wherein said protrusion means comprise tine-like members mounted to the cam members and extending generally radially outward from the outer circumferential edge surface thereof.

6. The clock apparatus of claim 5 wherein a single tine-like member is mounted to each cam member.

7. A clock apparatus including in combination housing enclosure means having an outer wall defining window-like apertures therein, time of day indicia provided in time-indicating referenced association with the apertures, a plurality of moveable spheroids each of said spheroids associated with a separate on of said window-like apertures, chute assembly means supported in the housing enclosure means for holding the moveable spheroids in non-time indicating positions out of framed alignment with associated apertures, said chute assembly means comprising a plurality of parallel spaced apart vertical wall members having their upper surfaces recessed to define concavical trough areas lying between adjacent pairs of vertical wall members, and the moveable spheroids are stored in the non-time indicating positions in the concavical trough areas, spheroid holder display means moveable between first positions thereof aligned to receive and hold spheroids positioned thereon in framed alignment with associated apertures, and second positions thereof aligned to return the spheroids to the chute assembly means, the spheroids being positioned to rest on the spheroid holder display means in framed alignment with associated apertures to indicate attained time of day, time-referenced loading means for loading with predetermined time referenced motion thereof the spheroids from the chute assembly means. on to the spheroid display means, said time-referenced loading means to be moved in response to a timing source means, said time-referenced loading means comprising rotatable drive shaft means supported in the housing enclosure means and being driven through detachable coupling to said timing source means, and cam means mounted on the drive shaft means and rotatable therewith for selectively engaging and moving the spheroids on to the spheroid holder display means with predetermined time-referenced motion thereof determined by the timing source means and the detachable coupling thereto, said drive shaft means comprising a plurality of discontinuous rotatable drive shaft sections, gear means for intercoupling the plurality of drive shaft sections, said gear means providing selectable geared ratios of rotation between intercoupled drive shaft sections, first means for biasing the spheroid holder display means to remain in the first position thereof in response to first predetermined movements of the loading means, and second means for counter-biasing the spheroid holder display means to move to the second position thereof in response to second predetermined movements of the loading means.

8. A clock apparatus including in combination housing enclosure means having an outer wall defining window-like apertures therein, time of day indicia provided in time-indicating referenced association with the apertures, a plurality of moveable spheroids each of said spheroids associated with a separate one of said window-like apertures, chute assembly means supported in the housing enclosure means for holding the moveable spheroids in non-time indicating positions out of framed alignment with associated apertures, said chute assembly means comprising a plurality of parallel spaced apart vertical wall members having their upper surfaces recessed to define concavical trough areas lying between adjacent pairs of vertical wall members, and the moveable spheroids are stored in the non-time indicating positions in the concavical trough areas, spheroid holder display means moveable between first positions thereof aligned to receive and hold spheroids positioned thereon in framed alignment with associated apertures, and second positions thereof aligned to return the spheroids to the chute assembly means, the spheroids being positioned to rest on the spheroid holder display means in framed alignment with associated apertures to indicate attained time of day, time-referenced loading means for loading with predetermined time referenced motion thereof the spheroids from the chute assembly means on to the spheroid holder display means, said time-referenced loading means to be moved in response to a timing source means, said time-referenced loading means comprising rotatable drive shaft means supported in the housing enclosure means and being driven through detachable coupling to said timing source means, and cam means mounted on the drive shaft means and rotatable therewith for selectively engaging and moving the spheroids on to the spheroid holder display means with predetermined time-referenced motion thereof determined by the timing source means and the detachable coupling thereto, first means for biasing the spheroid holder display means to remain in the first position thereof in response to first predetermined movements of the loading means, said first means comprising timing cam means mounted on the drive shaft means and rotatable therewith, and cam follower means mounted on the spheroid holder display means and engageable with the timing cam means to hold the display means in said first position thereof in response to first predetermined movements of the timing cam means, and second means for counter-biasing the spheroid holder display means to move to the second position thereof in response to second predetermined movements of the loading means.

9. The clock apparatus of claim 8 wherein the timing cam means is generally cylindrical having an outer circumferential edge surface providing a first section thereof of uniform radius, and the cam follower means is effective to hold the display means in the first position thereof in response to the engagement with the first section of uniform radius comprising the first predetermined movements of the timing cam means.

10. A clock apparatus including in combination housing enclosure means having an outer wall defining window-like apertures therein, time of day indicia provided in time-indicating referenced association with the apertures, a plurality of moveable spheroids each of said spheroids associated with a separate one of said window-like apertures, chute assembly means supported in the housing enclosure means for holding the moveable spheroids in non-time indicating positions out of framed alignment with associated apertures said chute assembly means comprising a plurality of parallel spaced apart vertical wall members having their upper surfaces recessed to define concavical trough areas lying between adjacent pairs of vertical wall members, and the moveable spheroids are stored in the non-time indicating positions in the concavical trough areas, spheroid holder display means pivotable about a pivot axis thereof between first positions thereof aligned to receive and hold spheroids positioned thereon in framed alignment with associated apertures, and second positions thereof aligned to return the spheroids to the chute assembly means, the spheroids being positioned to rest on the spheroid holder display means in framed alignment with associated apertures to indicate attained time of day, time-referenced loading means for loading with predetermined time referenced motion thereof the spheroids from the chute assembly means on to the spheroid holder display means, said time-referenced loading means to be moved in response to a timing source means, said time-referenced loading means comprising rotatable drive shaft means supported in the housing enclosure means and being driven through detachable coupling to said timing source means, and cam means mounted on the drive shaft means and rotatable therewith for selectively engaging and moving the spheroids on to the spheroid holder display means with predetermined time-referenced motion thereof determined by the timing source means and the detachable coupling thereto, first means for biasing the spheroid holder display means to remain in the first position thereof in response to first predetermined movements of the loading means, and second means for counter-biasing the spheroid holder display means to move to the second position thereof in response to second predetermined movements of the loading means, said second means comprising timing cam means mounted on the drive shaft means and rotatable therewith, cam follower means mounted on the spheroid holder display means and engageable with the timing cam means, and a plurality of spheroids resting on the spheroid holder display means in off-center positions removed perpendicularly from the pivot axis of the moveable display means, said plurality of spheroids providing a torquing force about said pivot axis in response to second predetermined movements of the timing cam means.

11. The clock apparatus of claim 10 wherein the timing cam means is generally cylindrical having an outer circumferential edge surface providing a first section thereof of uniform radius and a second section thereof of irregular radius defining a recessed surface area, and the plurality of spheroids providing the torquing force are effective to move the display means to the second position thereof in response to the engagement of the cam follower means with the second section of irregular radius comprising the second predetermined movements of the timing cam means.

12. A clock apparatus including in combination a plurality of separable housing sections, each housing section having an outer wall defining selected aligned groups of apertures therein, time of day indicia provided on the outer wall in time-indicating referenced association with the apertures therein, a plurality of spheroids, spheroid holder display means moveable between first positions thereof aligned to receive and hold spheroids thereon and second positions thereof aligned to depart spheroids therefrom, said spheroids being positioned to rest on the spheroid holder display means to indicate attained time of day, and said apparatus also including rotatable drive shaft means supported in the housing sections and being driven by detachable timing source means, said drive shaft means comprising a plurality of discontinuous rotatable drive shaft sections, intermeshed gear means for intercoupling the plurality of drive shaft sections, said gear means providing selectable geared rotios of rotation between intercoupled drive shaft sections, selected numbers of said drive shaft sections being rotatably mounted in each separable housing section, and each such selected numbers of drive shaft sections being axially intercoupled by said intermeshed gear means for intercoupling the separable housing sections and providing a different time-related geared ratio of rotation between said intercoupled numbers of drive shaft sections for precipitating different relative degrees of axial rotation between the intercoupled drive shaft sections, cam means mounted on the drive shaft means and rotatable therewith for selectively engaging and moving the spheroids, on to the spheroid holder display means with predetermined time-referenced motion thereof, first means for biasing the spheroid holder display means to maintain the first position thereof in response to first selected movement of the cam means and second means for counter-biasing the spheroid holder display means to move to said second position thereof in response to second selected movement of the cam means, and chute assembly means in each of said housing sections for receiving said spheroids from said spheroid holder display means and collecting said spheroids for storage thereof until said spheroids are again selectively moved by the cam means on to the spheroid holder display means.

13. The clock apparatus of claim 12 wherein the selected groups of apertures are generally horizontally aligned with respect to each other.

14. The clock apparatus of claim 12 wherein the selected groups of apertures are generally vertically aligned with respect to each other.

15. The clock apparatus of claim 12 wherein the cam means are comprised of a plurality of cam members mounted on the drive shaft means, selected numbers of cam members being mounted on the drive shaft sections which are mounted in the separable housing sections, respectively, and are rotatable in time-referenced association with the associated one of the different time-related geared ratio of rotations therefor.

16. The clock apparatus of claim 15 wherein the selected numbers of rotatable cam members mounted in each separable housing section are equal to the numbers of spheroids held by the chute assembly means and are equal to the numbers of apertures defined in the outer wall of the housing section.

17. The clock apparatus of claim 16 wherein each cam member includes a tine-like member protruding outwardly therefrom which rotates in direct response to the rotation of the cam member and which engages the associated spheroid held on the chute assembly means and moves the spheroid therefrom onto the spheroid holder display means.

18. The clock apparatus of claim 17 wherein selected adjacent pairs of cam members are angularly rotated about the drive shaft means to provide a 72 degree angle of rotation separating adjacent pairs of the tine-like members, and selected other adjacent pairs of cam members are angularly rotated to provide a 30 degree angle of rotation separating adjacent pairs of the tine-like members.

19. A clock apparatus comprising a panel having a plurality of window-like apertures formed therein, a plurality of moveable time indicators each associated with a separate one of said window-like apertures, time indicator holding means for holding said indicators and for allowing movement of said indicators into and out of framed alignment with associated window-like apertures, and time referenced rotatable drive shaft means having a plurality of positioning means mounted on said drive shaft means and rotatable therewith for effecting selective movement of said time indicators into and out of framed alignment with associated apertures so that time indicators moved into framed alignment with associated apertures indicate the attained time of day.

20. A clock apparatus in accordance with claim 19, wherein said positioning means includes a plurality of cam means each of which is associated with and effects movement of a different one of said time indicators.

21. A clock apparatus in accordance with claim 19, wherein said drive shaft means comprises a plurality of discontinuous rotatable drive shaft sections, wherein said plurality of positioning means includes a plurality of cam means with at least one of said cam means mounted on each of said drive shaft sections for rotation therewith, each of which cam means is associated with and effects movement of a different one of said time indicators, and further comprises gear means for intercoupling the plurality of drive shaft sections, the gear means providing selectable geared ratios of rotation between intercoupled drive shaft sections.

22. A clock apparatus in accordance with claim 19 wherein said time referenced rotatable drive shaft means includes a timing source driving means, and wherein said drive shaft means further comprises detachable coupling means for allowing detachable coupling of the drive shaft means to the timing source driving means to thereby allow for manual adjustment of the indicated attained time of day.

23. A clock apparatus comprising a panel having a plurality of window-like apertures formed therein, a plurality of moveable spheroids each associated with a separate one of said window-like apertures, spheroid holding means for holding said spheroids and for allowing movement of said spheroids into and out of framed alignment with associated window-like apertures, and time referenced rotatable drive shaft means having a plurality of cam means associated with said spheroids, said cam means mounted on said drive shaft means and rotatable therewith for effecting selective movement of said spheroids into and out of framed alignment with associated apertures so that spheroids moved into framed alignment with associated apertures indicate the attained time of day.

24. A clock apparatus comprising at least one elongated, horizontally extending panel having a plurality of window-like, horizontally aligned apertures formed in said panel, a plurality of movable time indicators which are each capable of substantially filling an associated one of said window-like apertures, time referenced driving means, and rotatable drive shaft means having a plurality of positioning means mounted on said drive shaft means and rotatable therewith for effecting selective movement of each of said indicators in response to said time-referenced driving means between a first position where said indicator substantially fills an associated one of said apertures and a second position wherein said indicator is moved so that there is an absence of an indicator in said one associated apertures, said moving means being structured so that the linear array of all of said indicators in said first position corresponds to the time of day.

25. A clock apparatus comprising a panel having a plurality of window-like apertures formed therein, a plurality of movable time indicators each associated with a separate one of said window-like apertures, time indicator holding means for holding said indicators and for allowing movement of said indicators into and out of framed alignment with associated window-like apertures, and time referenced rotatable drive shaft means having a plurality of discontinuous rotatable drive shaft sections and having a plurality of positioning means for effecting selective movement of said time indicators into and out of framed alignement with associated apertures so that time indicators moved into framed alignment with associated apertures indicate the attained time of day, said clock apparatus further comprising gear means for intercoupling the plurality of drive shaft sections, the gear means providing selectable geared ratios of rotation between intercoupled drive shaft sections.

* * * * *